US006543853B1

(12) United States Patent
Splane, Jr.

(10) Patent No.: US 6,543,853 B1
(45) Date of Patent: Apr. 8, 2003

(54) MASSAGE CHAIR

(75) Inventor: Robson L. Splane, Jr., Granada Hills, CA (US)

(73) Assignee: LifeGear, Inc., Arcadia, CA (US)

( * ) Notice: Subject to any disclaimer, the term of this patent is extended or adjusted under 35 U.S.C. 154(b) by 0 days.

(21) Appl. No.: 10/008,755

(22) Filed: Nov. 8, 2001

(51) Int. Cl.[7] ..... A47C 7/50

(52) U.S. Cl. ..... 297/423.12; 297/195.11; 297/215.13; 297/423.11

(58) Field of Search ..... 297/195.11, 195.1, 297/215.13, 423.11, 423.12

(56) References Cited

U.S. PATENT DOCUMENTS 4,746,167 A * 5/1988 Palmer et al.
5,401,078 A * 3/1995 Riach
5,762,402 A * 6/1998 Gillotti
5,961,179 A * 10/1999 Dixon et al.
5,971,485 A * 10/1999 Clark
6,065,808 A * 5/2000 Tinsley

* cited by examiner

*Primary Examiner*—Laurie K. Cranmer
(74) *Attorney, Agent, or Firm*—Selitto, Behr & Kim

(57) ABSTRACT

A massage chair including a main support frame and large and small curved rod frames. Specifically, the user can use a retaining pin to engage any of several round holes formed in the intermediate section of the main support frame to adjust the position of the hip pad, which is mounted to the large curved rod frame, which rides on a block secured to the retaining pin. The main support frame abuts against an eccentric angular block to enable the user to adjust the distance between the curved part of the main support frame against which the angular block abuts and the center of rotation of the block to permit micro-adjustment of the inclination of the main support frame.

3 Claims, 7 Drawing Sheets

MASSAGE CHAIR

BACKGROUND OF THE INVENTION

This invention relates to a massage chair and, more particularly, to a massage chair with pads for the head, chest, hip and leg portions that permit adjustment of the angles of inclination thereof to thereby provide an ergonomic massage chair.

Conventional massage chairs are usually ergonomically designed to help users relax their tense muscles during a massage. However, the chest pad and leg pad of a conventional massage chair are not provided with any adjusting structure. Thus, for a relatively short user (having a short upper trunk), although the seat pad can be adjusted to a higher position, the user's chest cannot comfortably lie against the chest pad. Further, the user's head cannot lie against the head pad comfortably.

It would therefore be desirable to provide a massage chair that includes pads for the user's head, chest, hips and legs that permits adjustment of angles of inclination thereof so as to provide an ergonomic construction that enables the user to be supported comfortably during a massage so that the user can completely relax his/her muscles.

SUMMARY OF THE INVENTION

Accordingly, the massage chair of the present invention includes a main support frame and large and small curved rod frames. The main support frame has a top end fitted with a supporting block and is provided with a chest support plate secured to the supporting block. The main support frame below the supporting block is provided with an inverted U-shaped hand support frame and a face support frame. Two curved rods extend in parallel from a transverse rod of a large curved rod frame, the distal ends thereof being provided with a hip support plate. A small curved rod frame includes two T-shaped curved rods, each correspondingly provided with a pivotable leg support plate. A curved part of the main support frame abuts against an eccentric angular block which is secured to the large curved rod frame. A transverse retaining block abuts against a recessed part of the main support frame, and the distal section of the large curved rod frame abuts against left and right sides of the transverse retaining block. The transverse retaining block can be secured to the main support frame at a selected one of a plurality of positions to vary the height of the hip support plate and the eccentric angular block can be rotated to vary the inclination of the main support frame.

BRIEF DESCRIPTION OF THE DRAWINGS

The foregoing and other features and advantages of the present invention will be more clearly understood from the following detailed description and the accompanying drawings, in which like elements in different figures thereof are identified by the same reference numeral and wherein.

DETAILED DESCRIPTION

Figure 1:
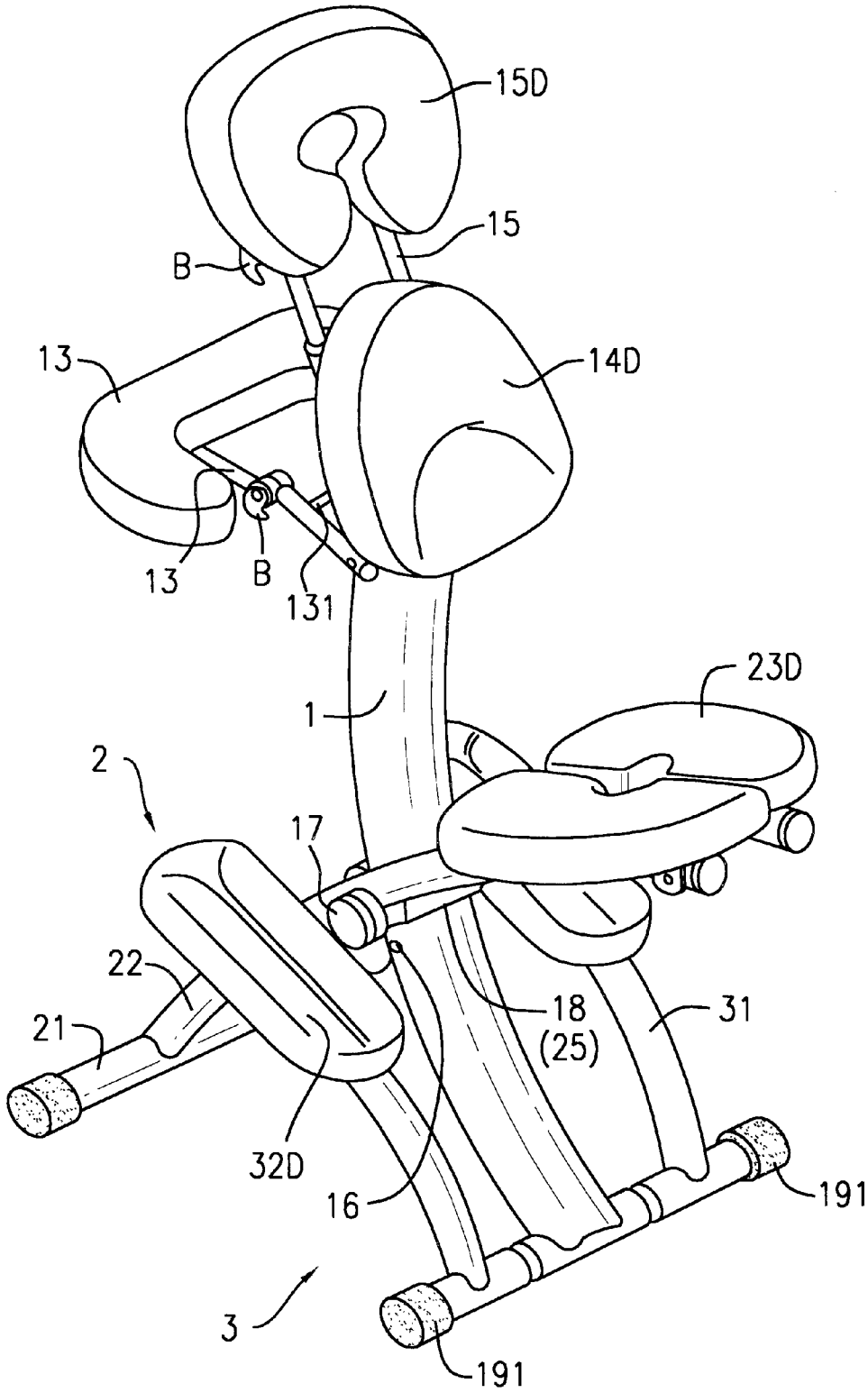
FIG. 1 is a perspective view of a massage chair constructed in accordance with the principles of this invention.
Figure 2:
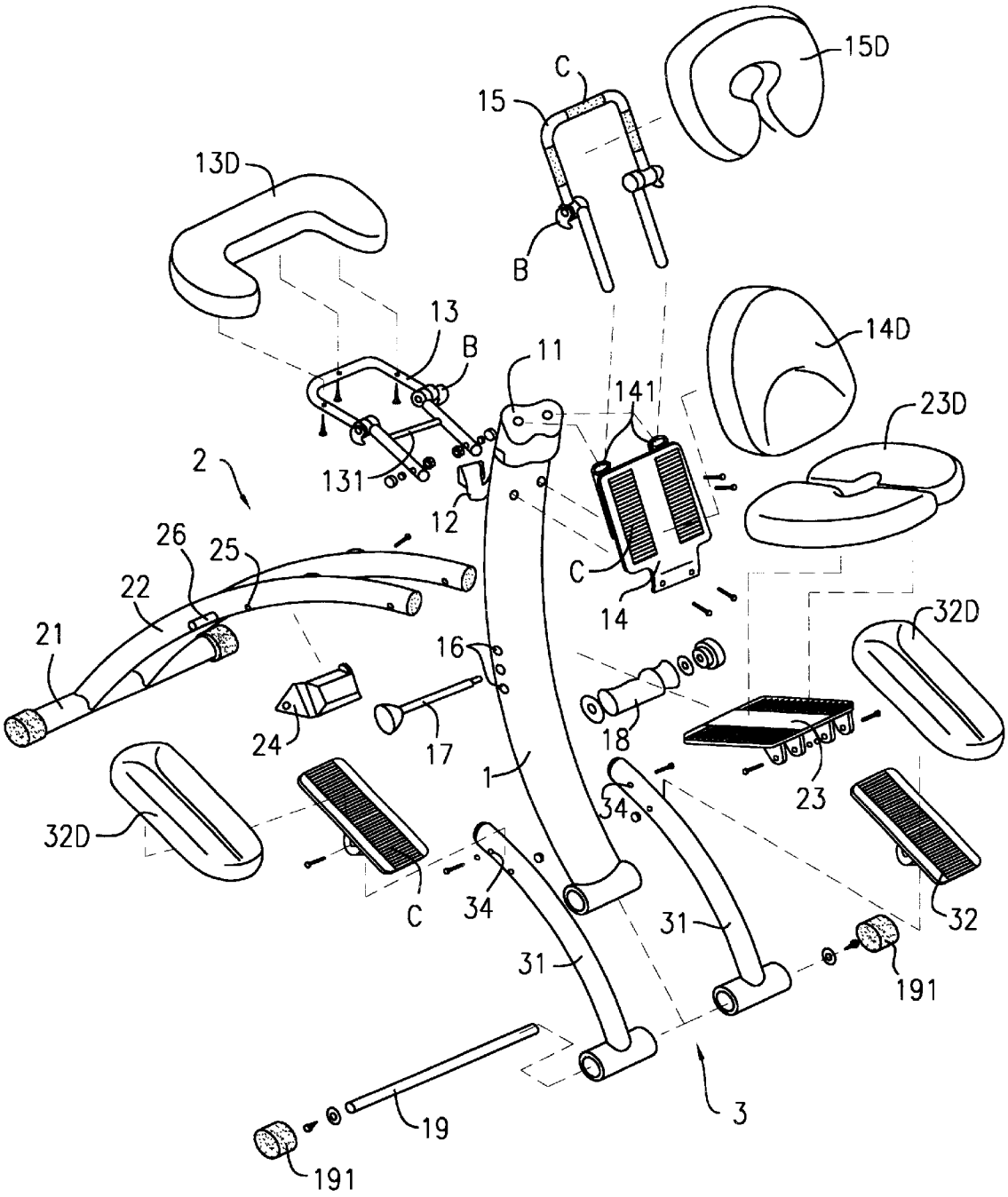
FIG. 2 is an exploded perspective view of the massage chair shown in FIG. 1.

Referring to FIGS. 1 and 2, a massage chair according to the present invention includes a main support frame 1, a large curved rod frame 2, and a small curved rod frame 3.

The main support frame 1 is a generally T-shaped curved member, preferably kidney shaped in cross section, a top end of which is fitted with a supporting block 11. The supporting block 11 has a lateral side provided with a supporting belt 12 extending therefrom, and a lower side having secured thereto an inverted U-shaped hand support frame 13, which is provided with a transverse rod 131. The belt 12 is wrapped around the transverse rod 131 to provide support for the hand support frame 13. The upper surface of the supporting block 11 is a slanting surface for locking of a chest support plate 14 thereonto. The bottom edge of the chest support plate 14 is correspondingly provided with two insert tubes 141 for insertably mounting an inverted U-shaped face support frame 15. The main support frame 1 is provided with three round holes 16. The holes 16 are spaced along the curve of the curved member. A retaining pin 17 is provided to extend through a selected one of the round holes 16 and a transverse retaining block 18, thereby allowing the block 18 to be mounted at a selected height.

The large curved rod frame 2 is provided with a transverse bar 21 which has two curved rods 22, preferably ovoidal in cross section, extending therefrom in parallel. A hip support plate 23 is pivotably mounted at the distal ends of the curved rods 22. The intermediate sections of the curved rods 22 are provided with through holes 25 for mounting an eccentric angular block 24 between the curved rods 22.

The small curved rod frame 3 is constituted by two T-shaped curved rods 31, preferably ovoidal in cross section, which are each provided with a respective leg support plate 32 pivotably mounted thereto.

Figure 3:
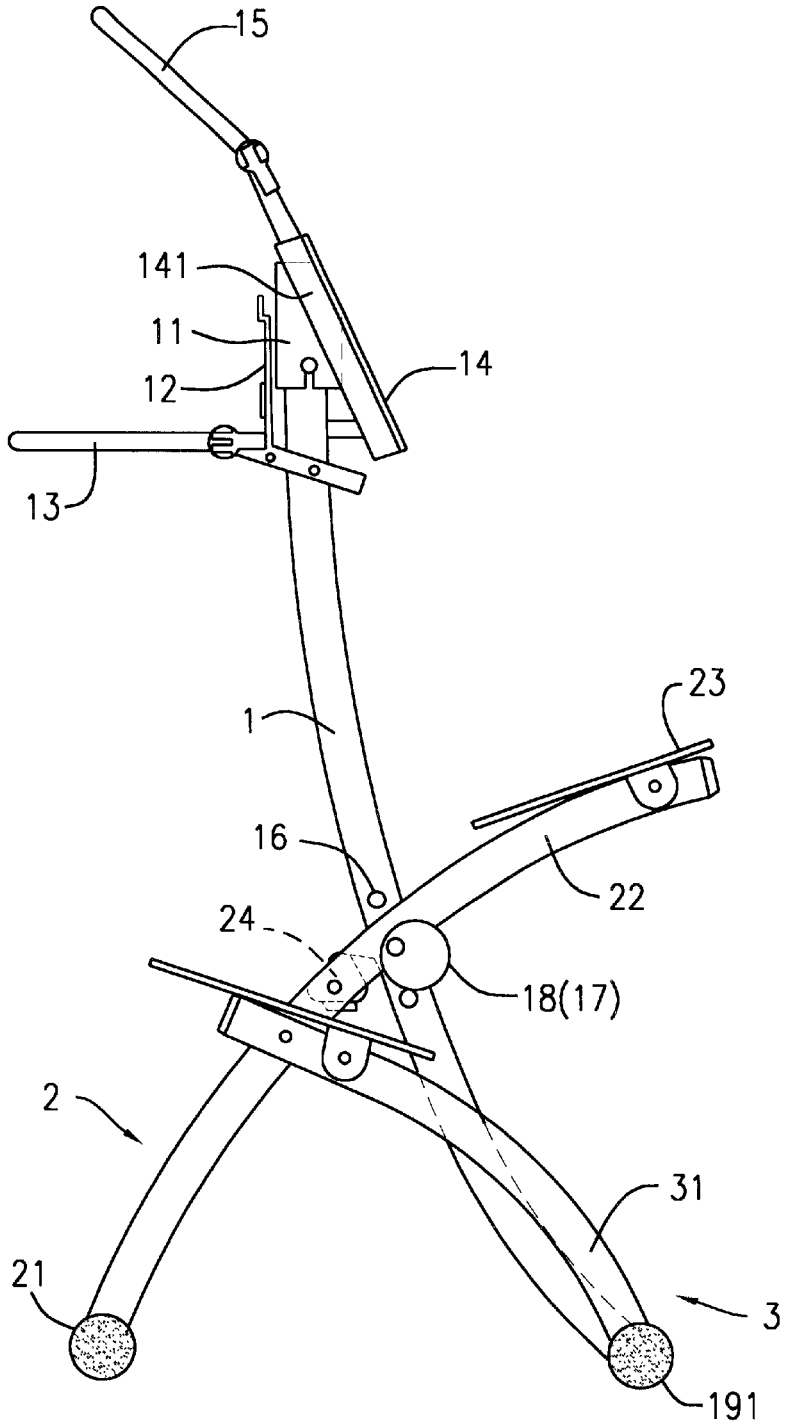
FIG. 3 is a side view of the massage chair shown in FIG. 1, without the support pads.
Figure 4:
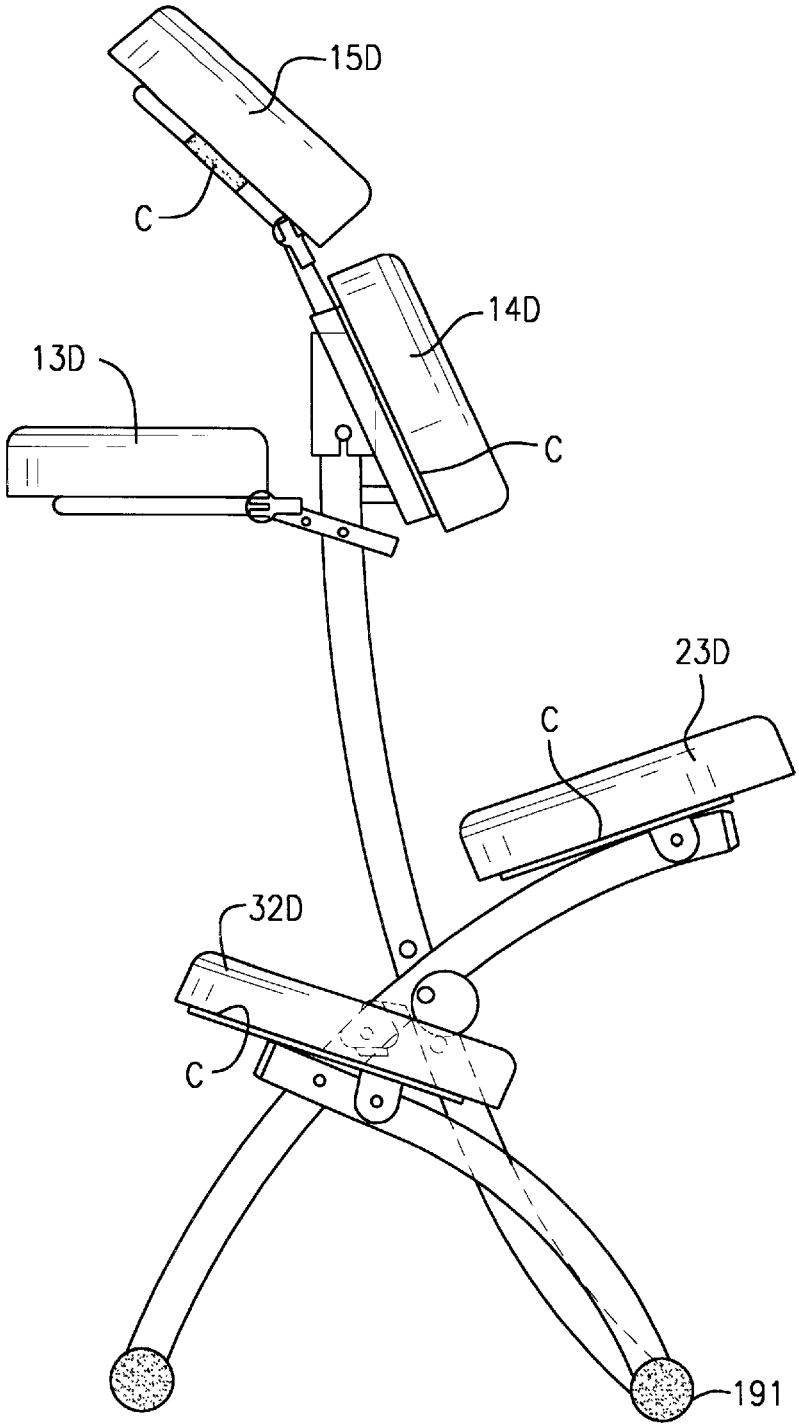
FIG. 4 is a side view of the massage chair shown in FIG. 1, with the support pads.

With further reference to FIG. 3, during assembly the main support frame 1 and the T-shaped head ends of the two T-shaped curved rods 31 of the small curved rod frame 3 are fitted with soft sleeves, and are bolted together using a shaft 19, to which are mounted wheels 191. Thus, the main support frame 1 and the small curved rod frame 3 are relatively pivotable about the shaft 19. The distal end of the small curved rod frame 3 is provided with holes 34. Posts 26 on the intermediate section of the large curved rod frame 2 are inserted through the holes 34 so that the small curved rod fame 3 is pivotably mounted to the large curved rod frame 2. The main support frame 1 (curved parts) then abuts against the eccentric angular block 24. The transverse retaining block 18 is caused to abut against a recessed part of the main support frame 1, and the distal section of the large curved rod frame 2 is also brought to abut against left and right sides of the transverse retaining block 18. Thus, there is no direct connection between the main support frame 1 and the large curved rod frame 2. When the massage chair is collapsed or set up, there is no pivoting on a shared axis-instead the parts slide on the blocks 18 and 24. When collapsing the massage chair, the hip support plate 23 is pivoted underneath the large curved rod frame 2 to make the collapsed assembly more compact.

Referring to FIG. 2, the face support frame 15, chest support plate 14, hip support plate 23 and leg support plates 32, and face pad 15D, chest pad 14D, hip pad 23D, and leg pads 32D are correspondingly provided with hook and loop fasteners C to facilitate easy removal and fastening. The hand pad 13D is secured to the hand support frame 13 by screws or the like. The pads are shaped for comfort. Thus, the leg pads 32D are formed with longitudinal troughs so force is borne by the user's tibia, rather than the patella. The chest pad 14D has a concavity for the user's diaphragm. The hip pad 23D is split for ventilation.

Figure 5:
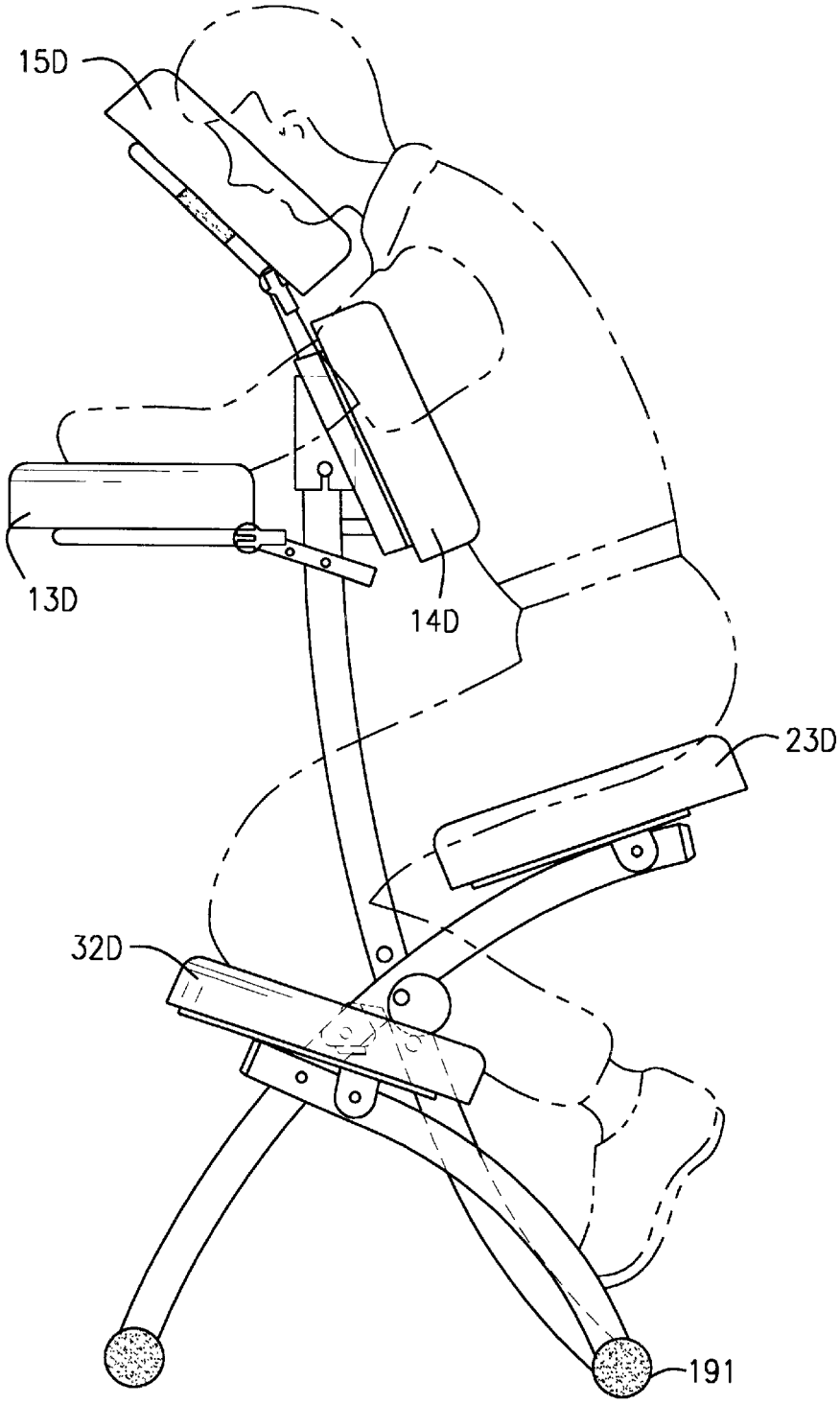
FIG. 5 is a side view of the massage chair shown in FIG. 1, in a state of use.

Referring to FIG. 5, when the user is supported on the massage chair of the invention, he/she takes a kneeling position with the legs resting on the leg pads 32D and the hips resting on the hip pad 23D. Since the leg support plates 32 can pivot, they automatically adjust to each user. The user can then put his/her chest against the chest pad 14D, with both hands placed on the hand pad 13D and the face resting on the face pad 15D so that the back muscles can be completely relaxed. After a proper massage, the user is relieved of body fatigue.

Figure 6:
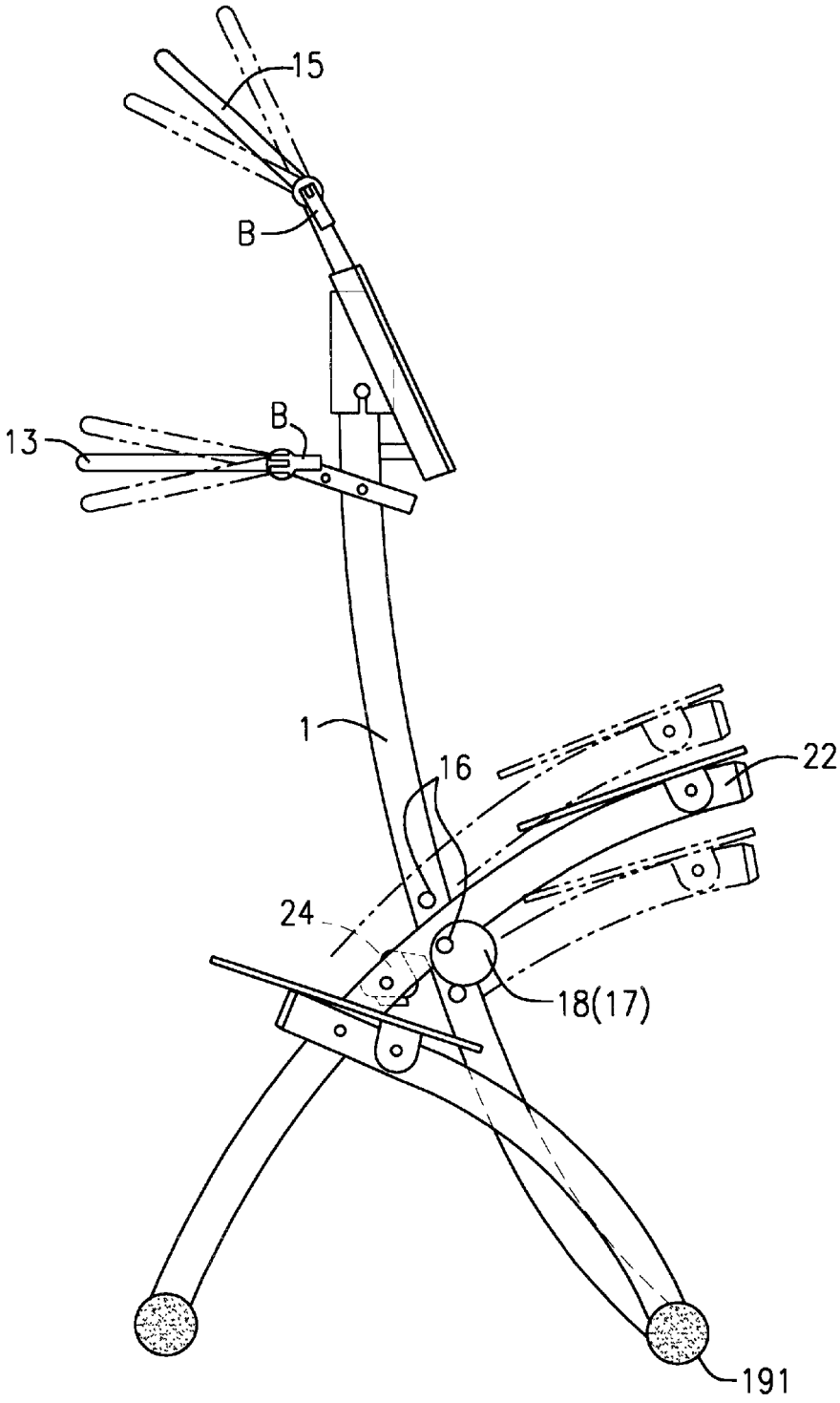
FIG. 6 is a side view showing how the massage chair shown in FIG. 3 can be adjusted.

Referring to FIG. 6, which illustrates adjustment of the massage chair of the invention, when the user wants to adjust the height of the hip pad 23D, the retaining pin 17 can be moved to selectively engage any one of the three round holes 16 in the main support frame 1 to adjust the height of the hip support plate 23. The hand support frame 13 and face support frame 15 are provided with angle adjusting knobs B to facilitate the user's adjustment of the angles of the hand pad 13D and face pad 15D.

Figure 7:
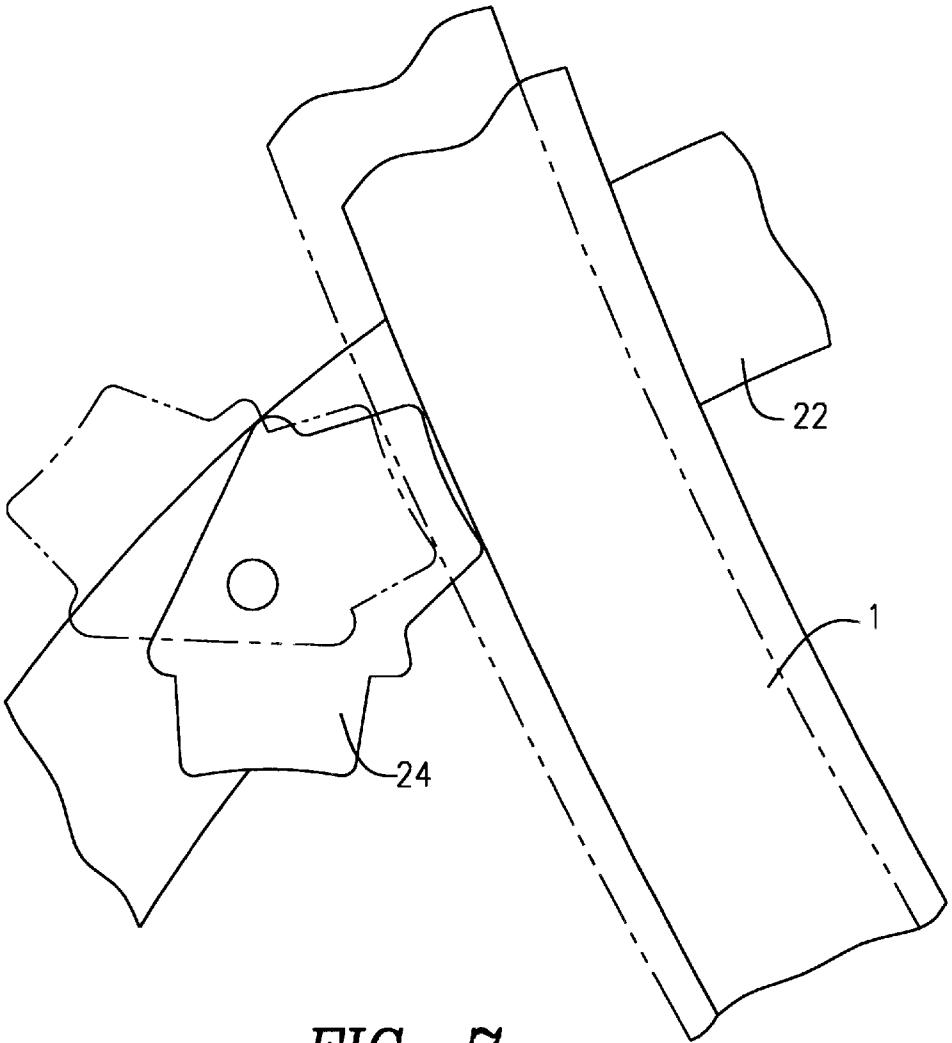
FIG. 7 is an enlarged detail showing how the massage chair of the invention can be further adjusted.

Referring to FIG. 7, in which the main support frame 1 is abutting against the eccentric angular block 24, the user can rotate the block 24 to adjust the center distance between the curved part of the main support frame 1 against which the angular block 24 abuts and the center of rotation of the block 24 to thereby allow micro-adjustment of the angle of inclination of the main support frame 1.

Accordingly, the invention provides the following advantages, among others:

1. Due to the cooperation between the round holes in the intermediate section of the main support frame and the retaining pin, the user can insert the retaining pin in a selected one of the round holes to adjust the height of the hip support plate.

2. By virtue of the main support frame that abuts against the eccentric angular block, the user can rotate the angular block to adjust the eccentric distance from the main support frame so that the inclination of the main support frame is capable of micro-adjustment.

3. The pads at the face support, chest support, hip support and leg supports lend themselves to adjustment of angles of inclination to adapt to users of different heights.

4. The intermediate section of the transverse retaining block is provided with a curvature matching the recessed part of the main support frame, and the left and right distal ends thereof are provided with recessed edges for abutment by the large curved rod frame to thereby enhance stability of the massage chair.

5. The frames and pads for the face support, chest support, hand support, hip support and leg supports are provided with corresponding hook and loop fasteners to facilitate removal and fastening.

6. In view of the arrangement of the hook and loop fasteners, planar micro-adjustment of the pads on the frames thereof is permitted to adapt to different users.

7. The supporting belt extending from the lateral side of the supporting block can be wound around the transverse rod of the hand support rod to provide good support for the hand support rod.

Although the present invention has been illustrated and described with reference to the preferred embodiment thereof, it should be understood that it is in no way limited to the details of such embodiment but is capable of numerous modifications within the scope of the appended claims.

What is claimed is:

1. A massage chair comprising:

a main support frame including a T-shaped curved member formed with a plurality of through-holes spaced along the curve of the curved member, a supporting block having a slanting surface mounted to a top end of said curved rod, an inverted U-shaped hand support frame mounted to said curved rod adjacent its top and having a transverse rod, a supporting belt extending from a lateral side of said supporting block and wound around said transverse rod to effectively support the hand support frame, a chest support plate secured to said slanting surface of said supporting block with a bottom edge of said chest support plate being provided with two insert tubes, and an inverted U-shaped face support frame mounted in said two insert tubes of said chest support plate;

a large curved rod frame including a transverse bar, two curved rods extending from said transverse bar in parallel and having distal ends, and a hip support plate pivotably mounted to said distal ends of said two curved rods;

a small curved rod frame including two T-shaped curved rods, and a pair of leg support plates each pivotably mounted to a respective one of said two T-shaped curved rods;

an eccentric angular block rotatively mounted between the two curved rods of the large curved rod frame;

a transverse retaining block; and a retaining pin;

wherein the curved rod of the main support frame abuts against the eccentric angular block, the transverse retaining block abuts against a recessed part of the main support frame such that a distal section of the large curved rod frame abuts against left and right sides of the transverse retaining block, and the retaining pin extends through the transverse retaining block and a selected one of said plurality of through-holes in the curved member of the main support frame.

2. The massage chair as claimed in claim 1 further including a face pad, a chest pad, a hip pad and a pair of leg pads, and wherein said face support frame, said chest support plate, said hip support and said pair of leg support plates, and said face pad, said chest pad, said hip pad and said pair of leg pads are correspondingly provided with hook and loop fasteners to permit easy removal and fastening.

3. A massage chair comprising:

a main support frame including an elongated curved member formed with a plurality of through-holes spaced along an intermediate portion of the curve of the curved member, said curved member having a first end adapted for support on a floor;

a chest support mounted to the curved member remote from said first end;

a face support mounted to the curved member remote from said first end;

a hand support mounted to tile curved member remote from said first end;

a retaining block mountable to a selected one of said plurality of through-holes;

an elongated large curved rod frame having a first end adapted for support on the floor and an intermediate portion adapted to be supported by said retaining block;

a hip support mounted to said large curved rod frame remote from its first end;

an elongated small curved rod frame having a first end pivotably secured to the first end of the main support frame curved member and a second end pivotably secured to an intermediate portion of the large curved rod frame; and a pair of leg supports each pivotably mounted to the second end of the small curved rod frame.

* * * * *